United States Patent [19]

Kusunoki et al.

[11] Patent Number: 4,476,362

[45] Date of Patent: Oct. 9, 1984

[54] HIGH FREQUENCY HEATING APPARATUS

[75] Inventors: Shigeru Kusunoki, Yamatokoriyama; Hirofumi Yoshimura, Nara, both of Japan

[73] Assignee: Matsushita Electric Industrial Co., Ltd., Osaka, Japan

[21] Appl. No.: 460,553

[22] Filed: Jan. 24, 1983

Related U.S. Application Data

[63] Continuation of Ser. No. 223,149, Jan. 7, 1981, abandoned, which is a continuation of Ser. No. 964,446, Nov. 28, 1978, abandoned, which is a continuation of Ser. No. 685,166, May 11, 1976, abandoned.

[30] Foreign Application Priority Data

| | | | |
|---|---|---|---|
| May 19, 1975 | [JP] | Japan | 50-60392 |
| Jul. 17, 1975 | [JP] | Japan | 50-88182 |
| Jul. 18, 1975 | [JP] | Japan | 50-88750 |
| Sep. 29, 1975 | [JP] | Japan | 50-117960 |
| Oct. 27, 1975 | [JP] | Japan | 50-129486 |
| Nov. 10, 1975 | [JP] | Japan | 50-135356 |

[51] Int. Cl.[3] ..... H05B 6/72

[52] U.S. Cl. ..... 219/10.55 F; 219/10.55 R

[58] Field of Search ..... 219/10.55 F, 10.55 R, 219/10.55 E

[56] References Cited

U.S. PATENT DOCUMENTS

| | | | |
|---|---|---|---|
| 2,526,226 | 10/1950 | Gross | 219/10.55 F |
| 2,767,291 | 10/1956 | Ryckman, Jr. | 219/10.55 R |
| 2,961,520 | 11/1960 | Long | 219/10.55 F |
| 3,265,780 | 8/1966 | Long | 219/10.55 F |
| 3,436,507 | 4/1969 | Püschner | 219/10.55 F |
| 3,493,709 | 2/1970 | Lavoo et al. | 219/10.55 F |
| 3,643,055 | 2/1972 | Suzuki et al. | 219/10.55 F |
| 3,705,283 | 12/1972 | Sayer et al. | 219/10.55 A |
| 3,798,404 | 3/1974 | Simon et al. | 219/10.55 F |
| 3,843,862 | 10/1974 | Staats et al. | 219/10.55 F |
| 3,851,133 | 11/1974 | Dygve et al. | 219/10.55 F |
| 3,855,440 | 12/1974 | Staats et al. | 219/10.55 F |
| 3,939,320 | 2/1976 | Saad | 219/10.55 F |
| 4,028,521 | 6/1977 | Uyeda et al. | 219/10.55 F |

FOREIGN PATENT DOCUMENTS

| | | | |
|---|---|---|---|
| 2450904 | 4/1975 | Fed. Rep. of Germany | 219/10.55 |
| 468191 | 3/1967 | Japan | 219/10.55 F |
| 4735102 | 8/1967 | Japan | 219/10.55 F |
| 1439260 | 6/1976 | United Kingdom | 219/10.55 F |

*Primary Examiner*—Roy N. Envall, Jr.
*Assistant Examiner*—Philip H. Leung
*Attorney, Agent, or Firm*—Wenderoth, Lind & Ponack

[57] ABSTRACT

The present invention is a high frequency heating apparatus which has a high frequency oscillator for radiating high frequency energy when energized by a high voltage, a waveguide for propagating the high frequency energy from the high frequency oscillator to a heating cavity or heating chamber of the apparatus in which an object to be heated is placed, and an electric wave radiating member provided between and extending into the waveguide and the heating chamber. The electric wave radiating member both couples, through electric waves, the waveguide with the heating chamber and also radiates the high frequency energy into the heating chamber for uniform heat distribution within the heating chamber.

14 Claims, 24 Drawing Figures

HIGH FREQUENCY HEATING APPARATUS

This application is a continuation of now abandoned application Ser. No. 223,149, filed Jan. 7, 1981, which is, in turn, a continuation of now abandoned application Ser. No. 964,446, filed Nov. 28, 1978, which is, in turn, a continuation of now abandoned application Ser. No. 685,166, filed May 11, 1976.

BACKGROUND OF THE INVENTION

The present invention relates to a high frequency heating apparatus and more particularly, to a high frequency heating apparatus wherein improvements are made in the microwave feeding method and microwave radiator or antenna for varying the electric wave radiation pattern into the heating cavity with respect to time, thus advantageously achieving a more uniform heat distribution in space, facilitation of apparatus design through the possibility of separate analysis of the electric field distribution and the electric wave output, and an improved efficiency of electric wave output during small load operation.

When a conventional high frequency heatin apparatus, for example, a microwave oven, is investigated, there are various problems which have not been fully studied.

Firstly, one such problem is that the electric field distribution within the heating cavity is not sufficiently uniform. In other words, when electric waves are radiated into the heating cavity composed of electrically conductive material, standing waves are developed, with the cavity acting as a resonant cavity through interference between the incident waves radiated from the oscillator and the electric waves reflected through insufficient absorption thereof by the load. The modes of these standing waves are mainly determined by the dimensions of the heating cavity and the position at which the oscillator is installed. Meanwhile, the high frequency electric waves are radiated onto the load, with a radiation pattern corresponding to directivity of the electric wave radiator or antenna, the main components of which radiation pattern is determined by configuration and dimensions of the antenna. Since both the standing waves and radiation pattern are substantially fixed in space unless some particular countermeasures are taken, portions having a strong electric field and portions having a weak electric field are simultaneously present in the heating cavity, thus resulting in uneven heat distribution therein.

In order to cope with the above described problems, there have conventionally been proposed and put into practice a variety of countermeasures, the outstanding ones of which are installation of stirrers or employment of a rotatable table to place the object to be heard thereon. Neither of these, however, is a fundamental resolution of the problems.

Secondly, another problem involved in the conventional high frequency heating apparatus is that the degree of heating tends to differ between the upper portion and lower portion of the object to be heated such as food. For example, when milk or the like kept in a bottle is heated, it is often experienced that the milk in the upper portion of the bottle is too hot to drink, while the milk at the lower portion remains cold. This inconvenience is attributable to the radiation pattern described above, and mainly caused by the oscillating portion of the heating apparatus being strongly heated due to the installation of the oscillator at the upper part of the apparatus. To overcome the above described disadvantages, provision of the oscillating portion at the lower portion of the apparatus is considered. This arrangement, however, still has a disadvantage that since the distance between the oscillating portion and the object to be heated must be short for efficient utilization of the heating cavity. It is extremely difficult to make the electric field distribution on a planar or flat surface uniform, thus the concept is actually applied only to limited kinds of apparatus.

Thirdly, there is a further problem involved in the designing of such a known high frequency heating apparatus. This problem is that the analysis required to make the heating uniform cannot be separated from that to improve the electric wave efficiency through proper adjustment of the working point of the oscillator. When the problem as described above is considered, for example, with respect to a heating apparatus having stirrers or rotatable tables mentioned earlier, with these stirrers being designes mainly for uniform heat distribution, the configuration or mode or movement of the stirrer simultaneously causes variations with time of the substantial impedance, thus resulting in a large deviation from the optimum working point as observed from the oscillator. These drawbacks consequently bring about further problems such as insufficient output in spite of relatively favorable distribution or unsatisfactory distribution despite ample output, thus at the present state of the art making it necessary for the design to be a suitable compromise between these factors.

Fourthly, a still further problem of efficiency reduction is involved in the known high frequency heating apparatus. In the general practice, the rated electric wave output of a microwave oven is specified by the electric power consumed during a temperature rise with respect to a water load of 2000 c.c. It is commonly known in this line of industry, however, that when a water load of 100 c.c. is reached, the electric wave output is reduced to 50 to 60% of the rated output. Such a discrepancy may be avoided through an intended reduction of the rated output. These countermeasures, however, are not desirable from the view point of efficient utilization of the energy, and thus do not present fundamental resolution of the problems involved.

Most of the foregoing problems in the known high frequency heating apparatuses are mainly attributable to the power supplying systems for supplying electric waves into the heating cavity. Typical power supplying systems are briefly described hereinbelow. The known power supplying systems currently put into actual use may be broadly divided into a direct coupling system wherein the oscillator is directly coupled to the heating cavity or heating chamber, such as those disclosed in U.S. Pat. Nos. 2,763,757 and 2,813,185, a coaxial power supplying system, for example, those described in U.S. Pat. Nos. 2,632,090 and 3,221,132, and a wave guide power supplying method such as those detailed in U.S. Pat. Nos. 2,761,942 and 2,909,635. These prior art power supply systems, however, have merits and demerits as described hereinbelow.

Reference is made to FIGS. 1 to 3 showing schematic side sectional views of conventional microwave ovens (outer casings removed for clarity) employing the above described known power supply systems. In the heating apparatus of FIG. 1 employing the direct coupling system, an oscillator or magnetron m is directly mounted on the top wall ha of the oven walls defining the heating cavity or heating chamber h with an antenna a of the magnetron m extending into the heating cavity h for supplying high frequency energy thereinto. This arrangement, however, has a serious disadvantage in that matching or tuning of the oscillator and the load cannot be properly achieved when the dimensions of the heating cavity h as a resonant cavity and the position of the antenna a are defined, although advantageous in that a higher efficiency may be expected due to the absence of loss factor such as a waveguide (not shown) and that the antenna portion a having a rod-like shape is readily analyzed for its radiation pattern and exciting mechanism. This implies that it becomes extremely difficult in designing to simultaneously achieve uniform heat distribution in the heating cavity h and utilization of the oscillator m at a high efficiency.

In the waveguide power supplying system shown in FIG. 2, the electric waves radiated from the antenna a of the magnetron m which is mounted at one end of the waveguide w are propagated through the waveguide w disposed on the top wall ha of the heating chamber h and supplied into the chamber h through a rectangular opening wo formed in the other end of the waveguide w disposed on the top wall ha of the heating chamber h and supplied into the chamber h through a rectangular opening wo formed in the other end of the waveguide w. This opening wo has its width approximately equal to the width of the waveguide w. In the above arrangement, although the problems encounted may be smaller since the matching or tuning can be controlled outside of the heating cavity h, control of the radiation pattern is difficult because the radiation is effected through the opening wo of the waveguide w. More specifically, even if the opening wo is formed in the central portion of the wall ha of the heating cavity h, the radiation characteristics are still asymmetrical, thus making it extremely difficult to arrange the electric field to be evenly distributed within the heating cavity h.

Meanwhile, in the coaxial power supplying system of FIG. 3, the electric waves from the magnetron M are propagated through space between an outer conductor wa and an inner conductor wb into the heating cavity h for supplying high frequency energy thereinto. Although the above described coaxial power supplying system is advantageous as compared with the foregoing two systems of FIGS. 1 and 2 in the ease of matching and adjustment of the radiation pattern, the same system has disadvantages in that accurate dimensions of the outer conductor wa and inner conductor wb are particularly required due to the continuous construction of the inner conductor wb from the antenna of the oscillator m to the interior of the heating chamber h. The assembly of a number of components, i.e., the outer conductor wa, the inner conductor wb and the oscillator m in a predetermined relation gives rise to a further serious problem especially in the case of mass-production, thus adversely affecting the working efficiency.

Similarly, there have conventionally been proposed various arrangements for uniformly heating the object placed in the heating cavity, such as the stirrer method employing a vane or disk to be rotated in the heating cavity or the rotating table method for rotating, within the heating cavity, the object to be heated which is placed on the table. Each of these countermeasures, however, is of a secondary nature, and are not sufficient for the purpose of achieving the uniform heating of the object to be heated.

Meanwhile, an apparatus having a positive countermeasure of a primary nature for effecting the uniform heating has conventionally been proposed, for example, by U.S. Pat. No. 2,961,520. In that apparatus which has a coaxial power supplying system, as is clear from the statement in column 2, line 27 and after of the specification thereof, the junction between the fixed inner conductor extending from the magnetron and the inner conductor rotating at the heating cavity comes into question. More specifically, the arrangement of said U.S. Pat. No. 2,961,520 still presents various problems arising from limitations of the power supplying system, such as undesirable spark discharge at the junction, complicated choke construction, the necessity of precise dimension control and the countermeasures required upon adhesion of dirty matter to the junction.

Furthermore, in the conventional microwave ovens referred to in the foregoing description, it is a general disadvantage that, during heating through electric waves, the heat source is not visible with the eyes, thus psychologically giving rise to some uneasiness on the part of the user.

SUMMARY OF THE INVENTION

Accordingly, an essential object of the present invention is to provide a high frequency heating apparatus wherein improvements are made in the uniformity of horizontal heat distribution as well as in the heat distribution in a vertical direction with respect to a long and narrow object such as liquid contained in a bottle.

Another important object of the present invention is to provide a high frequency heating apparatus of the above described type wherein the improvements of uniform heat distribution and electric wave output can be separately analyzed for efficient design of the heating apparatus.

A further object of the present invention is to provide a high frequency heating apparatus of the above described type in which the efficiency of electric wave output is improved for a small load, with simultaneous efficient operation of the oscillator even at the rated output.

A still further object of the present invention is to provide a high frequency heating apparatus of the above described type wherein the electric power required for the heating apparatus on the whole is effectively utilized for efficient heating operation, with arrangements for the improvements of the heat distribution and working efficiency being adapted to be observed by eye during use.

Another object of the present invention is to provide a high frequency heating apparatus of the above described type which is accurate in functioning and simple in construction, with a consequently high manufacturing efficiency at low cost.

According to a preferred embodiment of the present invention, a high frequency heating apparatus in the form of a microwave oven includes a high frequency oscillator or generator which radiates high frequency energy upon energization thereof by a high voltage, a waveguide having the high frequency oscillator disposed at one end portion thereof for propagating the high frequency energy from the high frequency oscillator to the heating cavity or heating chamber of the microwave oven in which an object to be heated, for example a food article, is placed, and an electric wave radiating member provided between and extending into the waveguide and the heating chamber through a supporting member of dielectric material. The electric wave radiating member both couples, through electric waves, the waveguide with the heating chamber and also radiates the high frequency energy from the high frequency oscillator into the heating chamber. By this arrangement, the high frequency energy is uniformly distributed within the heating chamber both in horizontal and vertical directions, with substantial elimination of the disadvantages inherent in the conventional high frequency heating apparatus.

These and other objects and features of the present invention will become apparent from the following description taken in conjunction with the preferred embodiment thereof with reference to the attached drawings.

BRIEF DESCRIPTION OF THE DRAWINGS

Before the description of the present invention proceeds, it is to be noted that like parts are designated by like reference numerals throughout the several views of the attached drawings.

DESCRIPTION OF THE PREFERRED EMBODIMENT

Figure 4:
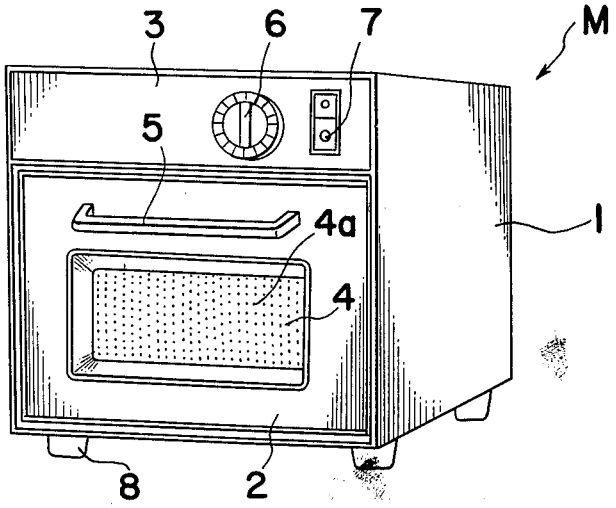
FIG. 4 is a perspective view of a high frequency heating apparatus in the form of a microwave oven according to one embodiment of the present invention.
Figure 5:
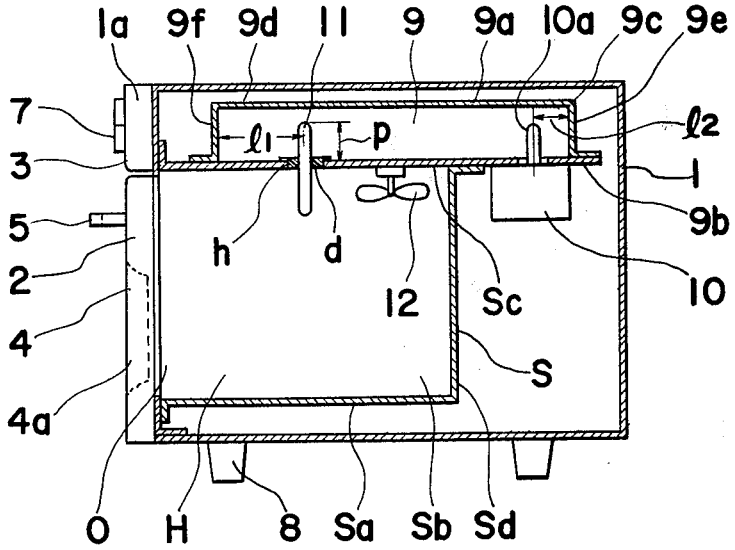
FIG. 5 is a side sectional view of the microwave oven of FIG. 4.
Figure 6:
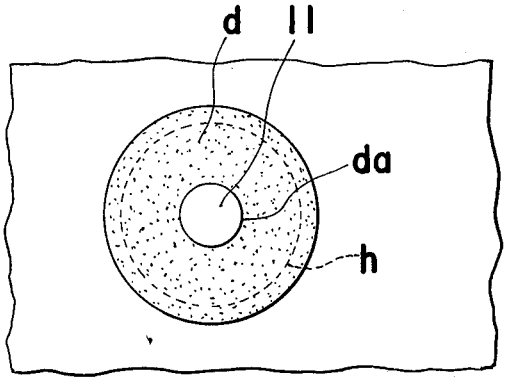
FIG. 6 is a fragmentary top plan view showing, on an enlarged scale, the arrangement of an electric wave radiating member disposed in an opening of a waveguide employed in the microwave oven of FIG. 5.

Referring now to FIGS. 4 to 6, there is shown a high frequency heating apparatus as applied to a microwave oven M according to one embodiment of the present invention. The microwave oven M includes an outer casing 1 having a cubic box-like configuration open at the front side thereof. The outer casing 1 has a double-walled structure and includes inner walls S of steel plates or similar material which defines the heating cavity or heating chamber H. These inner walls include a horizontal base plate Sa, vertical side walls Sb, a top wall Sc and a rear wall Sd, and thus define an access opening 0 at the front of the oven M. As is seen from FIG. 5, the outer surfaces of these walls Sa, Sb, Sc and Sd are spaced from the corresponding walls of the outer casing 1 to provide spaces therebetween. The outer casing 1 further includes an outside front wall portion 1*a* immediately above the access opening O, on which front wall portion 1*a*, there is mounted a control panel 3 carrying a timer knob 6, operating buttons 7 and the like. The microwave oven M further includes a door 2 having a handle 5 adjacent to one edge thereof remote from the hinge (not shown) with which the door 2 is supported at the lower edge thereof to the lower front edge of the casing 1 in a position corresponding to the access opening 0 for pivotal upward or downward movement so as to selectively open and close the access opening 0. Furthermore, the door 2 has a rectangular opening 4 formed in the central portion thereof, in which opening 4 a transparent plate member and a shielding plate such as a punched metal plate or the like (not shown) for shielding the microwave are closely fitted to form an observation window 4*a* in the door 2 for observation of an object (not shown) placed within the heating chamber H. The casing 1 is provided with legs 8 for stable positioning of the microwave oven M.

Figure 1:
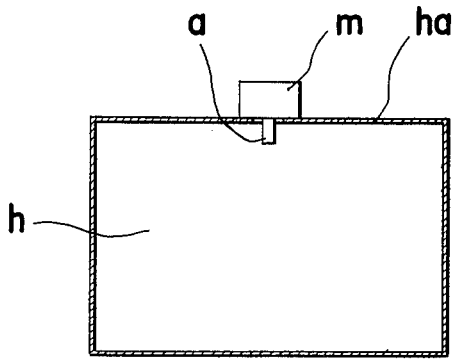
FIG. 1 Prior Art
FIG. 1 is a sectional side view of a conventional microwave oven using a direct coupling system for the high frequency energy.
Figure 2:
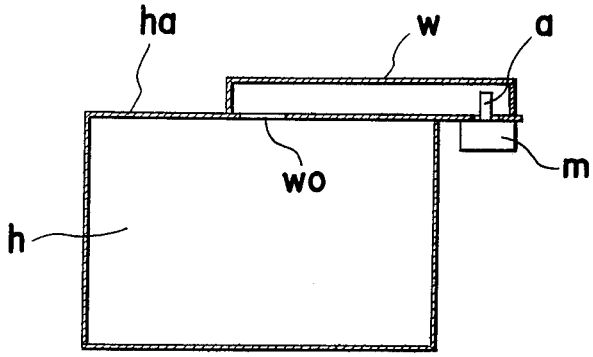
FIG. 2 Prior Art
FIG. 2 is a sectional side view of a conventional microwave oven using a waveguide coupling system for the high frequency energy.
Figure 3:
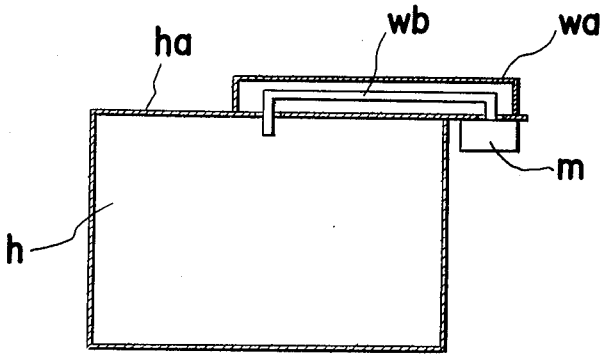
FIG. 3 Prior Art
FIG. 3 is a sectional side view of a conventional microwave oven using a coaxial coupling system for the high frequency energy.

It should be noted here that the configuration and construction of the outer casing 1 are not limited to those described above with reference to the microwave oven M of FIG. 1, but may be suitable changed to any other shape and construction within the scope of the arrangements according to the invention which are detailed hereinbelow.

Referring particularly to FIG. 5, in the space defined by the top wall Sc of the heating cavity S and the corresponding top wall of the casing 1, there is disposed, on the top wall Sc, a waveguide 9 which is formed by part of said top wall Sc and a cober member 9a. One end 9c of the waveguide 9 extends into the space between the rear wall Sd of the heating cavity H and the corresponding rear wall of the casing 1. At the end 9c of the waveguide 9, on the under surface of a base plate 9b thereof integrally formed with the top wall Sc of the heating chamber H, there is mounted a magnetron 10 which is energized by a high voltage source (not shown) upon depression of the operating button 7. Its antenna 10a extends upwardly into the waveguide 9 through a small opening formed in the base plate 9b and with the axis of the antenna 10a being spaced from a rear wall 9e of the waveguide 9 by a distance l2. Generally at the central portion of the top wall Sc of the heating chamber H which forms part of the base plate 9b of the waveguide 9, there is formed a small opening h in which a circular supporting member d of low loss dielectric material having a concentric small opening da therein is fitted. An electric wave radiating member of antenna 11 is inserted into the concentric small opening da and supported by the supporting member d to extend both into the waveguide 9 and the heating chamber H. The vertical axis of the antenna 11 is spaced from the front wall 9f at the other end 9d of the waveguide 9 by a distance l1. On the under surface of the top wall Sc of the chamber H in a position between the antenna 11 and the rear wall Sd, there is rotatably mounted a stirrer fan 12 which is driven by suitable driving means (not shown) for stirring the high frequency energy in the heating chamber H.

By this arrangement, the high frequency energy generated by the magnetron 10 energized by a high voltage upon depression of the operating button 7 and radiated by the antenna 10a is propagated through the waveguide 9 and supplied into the heating chamber H through the electric wave radiating means or antenna 11 and is further stirred by the stirrer 12 for efficent heating of the object (not shown), preferrably contained in a vessel (not shown) and placed on the bottom wall Sa of the chamber H.

It should be noted here that the small opening h formed in the top wall Sc between the waveguide 9 and the heating chamber H should not be so large in diameter as to permit loose coupling between the waveguide portion 9 and the heating chamber H in the absence of the antenna 11. More specifically, the relation between the waveguide 9 and the heating chamber H should be so arranged in design that high frequency energy is hardly supplied into the heating chamber H through the opening h alone as in the punched metal employed for the observation window 4a of the door 4, but that when an electrically conductive material, for example, a metallic rod is inserted into the opening h, a large amount of the high frequency energy is supplied into the chamber H. By arranging the apparatus in the manner as described above, it becomes possible to readily control the heat distribution as in the direct coupling method, since the electric field distribution in the heating chamber H is conveniently determined only on the basis of the configuration of the antenna 11 within the chamber H. In this case, the opening h of small circular shape, unlike the conventional waveguide arrangement, advantageously eliminates the possibility of developing directivity in the radiating characteristics. It is another advantage of the above described arrangement that the electrical output of the oven M can be analyzed almost independently of the electric field distribution within the heating chamber H. More specifically, it is possible to arbitrarily control the working point of the magnetron 10 through alterations of the distances l1, from the antenna 11' to the front wall 9f, and l2, from the antenna 10a and the rear wall 9e of the waveguide 9, and also the length of the antenna 11 extends into the waveguide 9. As is seen from the above description, the metallic rod 11 serves a combined purpose as an electric wave coupling member between the heating chamber H and the waveguide 9, and also as the electric wave radiating member, i.e., antenna.

Figure 7:
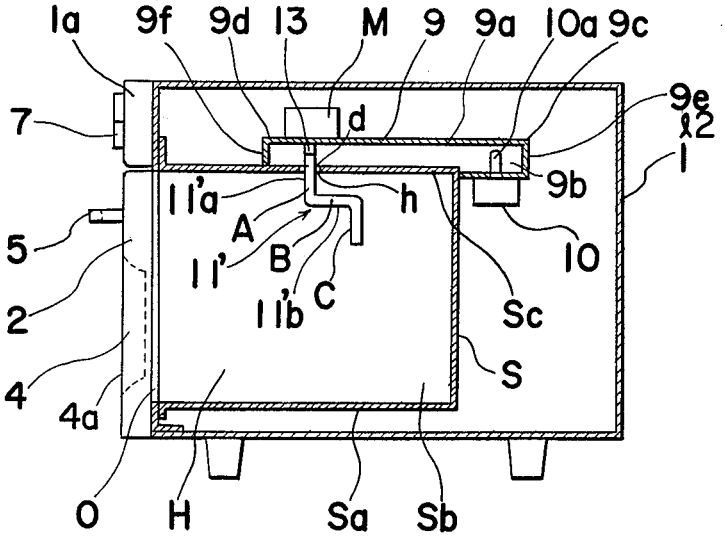
FIG. 7 is a similar view to FIG. 5 but particularly showing a modification thereof.

Referring now to FIG. 7, there is shown a modification of the embodiment of FIGS. 5 and 6. In this modification, the metallic rod 11 for the antenna described as employed in the microwave oven of FIGS. 5 and 6 is replaced by an electric wave radiating member 11' having an L-shaped portion 11'b at one end thereof extending into the heating chamber H, with the other end 11'a thereof extending upwardly through an opening h1 formed in the top wall Sc of the chamber H into waveguide 9 being further connected, through a supporting rod 13 of a dielectric material, to the driving shaft of a motor M mounted on the cover member 9a of the waveguide 9 for rotation of the radiating member 11' within the heating chamber H upon energization of the motor M. By the above arrangement, the effect to be obtainable when the radiating member moves about in the heating chamber H is readily achieved through rotation of the member 11', thus contributing greatly to the uniform distribution of the electric field within the heating chamber H. Although the stirrer 12 is dispensed within the modification of FIG. 7, it is needless to say that such a stirrer may be further provided for further improvement of the even distribution of the electric field. Furthermore, the waveguide 9 described as constituted by a part of the top wall Sc of the heating chamber H and the cover member 9a may be replaced by a waveguide separately prepared and mounted on the top wall Sc of the chamber H. Similarly, the opening h1 formed in the top wall Sc for insertion of the radiating member 11' therethrough may further be fitted with a member similar to a support member d of low loss dielectric material as in the embodiment of FIGS. 4 to 6. The remainder of the construction and function of the microwave oven of FIG. 7 is similar to those described with reference to the oven of FIGS. 4 to 6, so that detailed description thereof is omitted.

Figure 8:
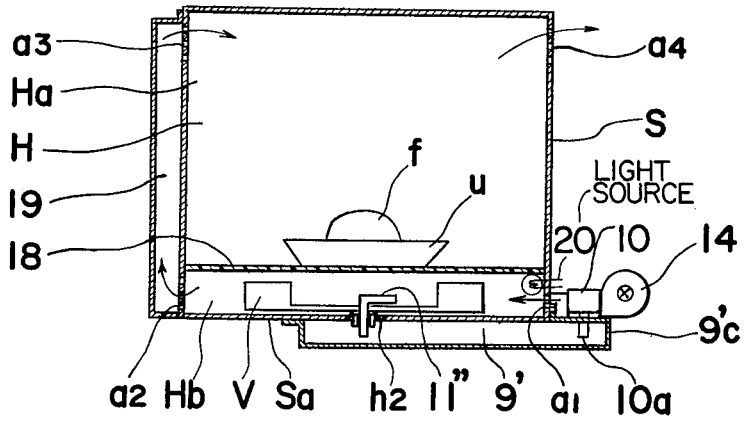
FIG. 8 is a similar view to FIG. 5, but particularly showing another modification thereof.
Figure 9:
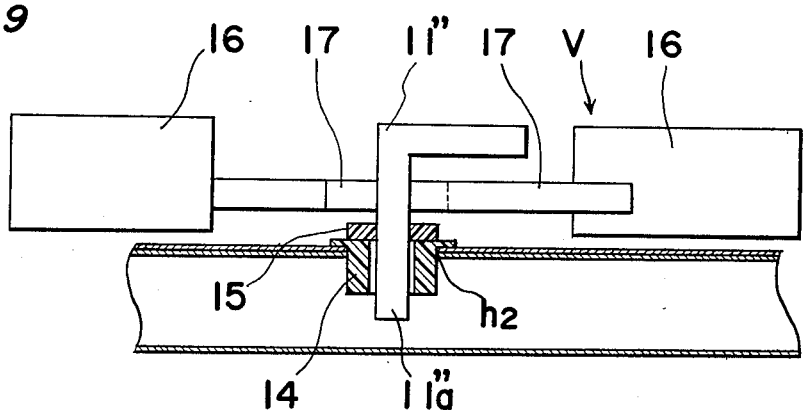
FIG. 9 is a side elevational view, partly in section and on an enlarged scale, showing the arrangement of an impeller and an electric wave radiating member employed in the microwave oven of FIG. 8.

Referring now to FIGS. 8 and 9, there is shown another modification of the microwave oven of FIGS. 4 to 6. In this modification wherein the outer casing 1 of the oven is removed fro clarity of description, the waveguide 9 described as mounted on the top wall Sc of the heating chamber H in the oven of FIGS. 4 to 6 is replaced by a waveguide 9' mounted to the under surface of the bottom wall Sa of the chamber H in a space between the wall Sa and the corresponding bottom plate of the casing 1 (not shown). At the end 9'c of the waveguide 9' in a position adjacent to the magnetron 10, there is mounted a fan or blower 14 suitably coupled with a driving motor (not shown) for cooling the magnetron 10. Approximately, in the central portion of the bottom wall Sc of the chamber H, there is formed an opening h2 in which a bearing 14 of low loss dielectric material is received. An electric wave radiating member 11'' of L-shape is inserted, at its end 11''a, into the bearing 14 and supported on the bearing 14 by a ring member 15 of similar low loss dielectric material fixed to the radiating member 11'' for permitting rotation of the member 11'' in the bearing 14. The radiating member 11" is further provided with a plurality of blades 16 of low loss dielectric material which are secured to the member 11" through corresponding arms 17 also of low loss dielectric material to form an impeller V around the radiating member 11". Above the impeller V, a support plate 18 is disposed within the heating chamber H to divide the chamber H into two portions Ha and Hb, on which support plate 18, the object to be heated, for example, food f place in a vessel U is placed. The heating chamber H is formed with ventilation openings a1 to a4 in the walls adjacent to the corner portions thereof and is further provided with a duct portion 19 fixed at one side. The duct 19, the opening a1, the heating chamber Hb for the impeller V, the opening a3, the upper heating chamber Ha and the opening a4 are communicated with one another for the circulation of air flow in the directions shown by arrows.

By the above arrangement, when the blower 14 is operated, the air flow developed thereby is directed through the opening a1 and the chamber Hb after having cooled the magnetron 10, thus rotating the impeller V together with the electric wave radiating member 11". The air flow is further led into the heating chamber Ha through the openings a2, the duct 19 and the opening a3 and finally is discharged, through the opening a4, out of the chamber Ha together with vapor generated in said chamber H during heating. Supplying the electric power from the lower side according to the invention as described above has various advantages over known arrangements in that influence due to radiation is larger than that by resonance since the electric wave radiating member or antenna is disposed close to the object to be heated. By such an arrangement, the distribution of the electric field is readily improved by controlling the radiation pattern through analysis made into the configuration of the electric wave radiating member. Furthermore, because the electric power is supplied from the lower portion of the heating chamber H, the temperature difference between the upper and lower portions of a long and narrow object, for example, the liquid contained in a bottle, can be minimized rather easily. Additionally, efficient utilization of the magnetron is achieved since the impedance variations resulting from rotation angle of the radiating member can be reduced through negligible influence of resonance by the heating cavity and through designing to accumulate energy in the electric wave radiating portion. Similarly, output reduction at the time of small load can also be prevented.

Figure 10:
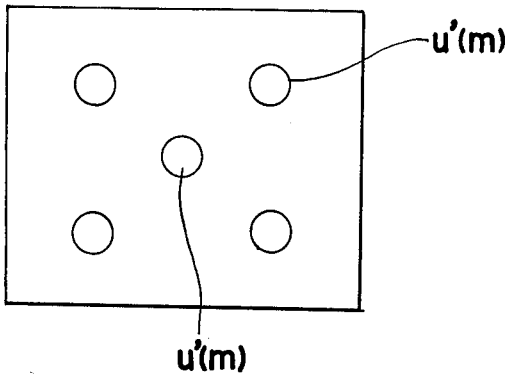
FIG. 10 is a schematic top plan view showing the arrangement of sample vessels on the bottom plate of the heating chamber employed for comparative heating tests between the conventional microwave oven and the high frequency heating apparatus of the present invention.
Figure 11:
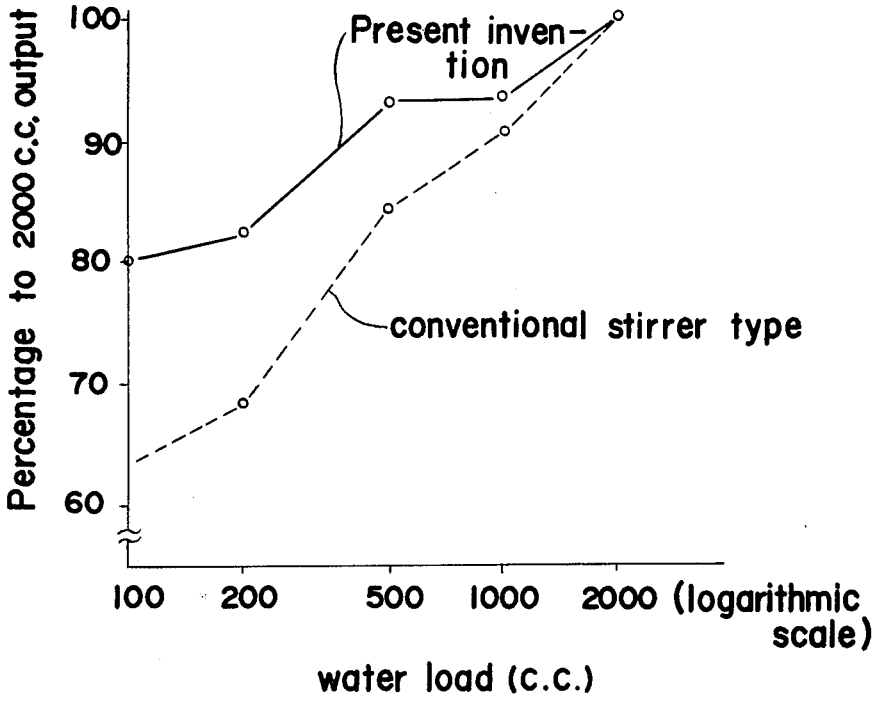
FIG. 11 is a graph showing a comparision of the characteristics for a small load between the conventional microwave oven and the high frequency heating apparatus of the invention.

FIGS. 10 and 11 refer to a comparison between the conventional microwave oven of the stirrer type and the microwave oven according to the present invention. A heat distribution test was carried out, with vessels U' each containing 100 c.c. of water disposed on the bottom plates within the heating chambers of the conventional oven of the stirrer type and the oven of the invention in the symmetrical positions as shown in FIG. 10. Both of the ovens were then energized to reach a predetermined maximum temperature for subsequent temperature difference measurements between the water containing vessels U' in each of the ovens. As a result, in the case of the conventional oven of the stirrer type, temperature difference of 7° C. was detected between the water in these vessels, while in the oven of the present invention the temperature difference was as small as 2° C.

Furthermore, under conditions similar to above, milk bottles m each containing 200 c.c. of water were disposed in the same positions as in the above described test, and another test measuring the temperature difference between the upper and lower portions of water in each of the bottles m was carried out. As a result of which test, a temperature difference of 23° C. was measured in the conventional oven of the stirrer type, while the oven of the invention gave temperature difference of 2° C.

FIG. 11 shows a comparison of the characteristics for a small load between the conventional microwave oven of the stirrer type and the microwave oven of the present invention. A difference of ten-odd percent is noticed at the water load of 100 c.c.

It should be noted here that, in the microwave oven of FIG. 8 of the invention, if the supporting plate for the object or food f to be heated is made of a light transmitting material, such as a transparent or semi-transparent material, with a suitable light source 20 for illumination being disposed in a position below the supporting plate, favorable psychological effect on the part of the user can be expected. In other words, in the conventional microwave ovens, there has been some uncertainty that the user cannot directly see conditions of the heat source by eye. This psychological uneasiness is advantageously eliminated by the above described arrangement, since the movement of the electric wave radiating member in the heating chamber can be observed, thus permitting the user to actually feel that the electric waves being radiated.

Figure 12:
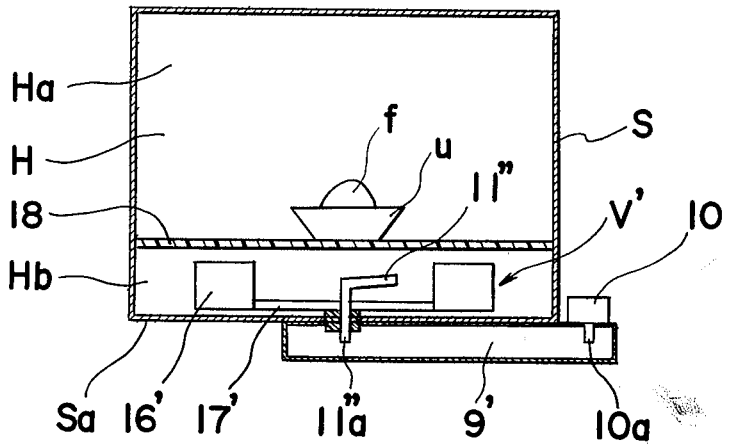
FIGS. 12 and 13 are views similar to FIG. 8, but particularly showing further modifications thereof.
Figure 13:
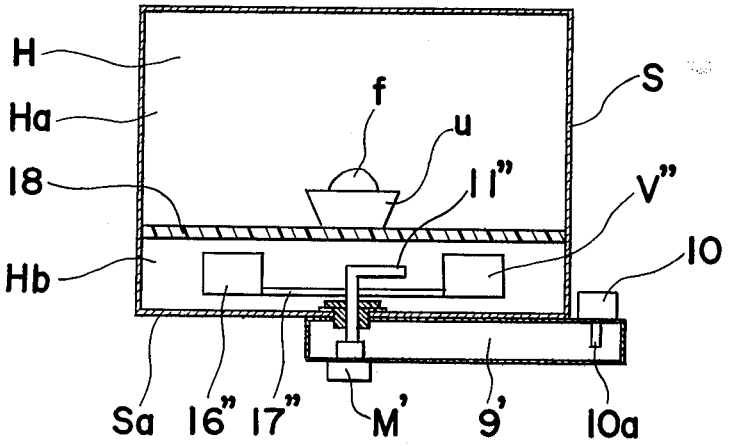

Referring now to FIGS. 12 and 13, there are shown further modifications of the microwave oven of FIG. 8. In these modifications, reflectors for the electric waves are incorporated for further improvement of the electric field distribution.

In the microwave oven of the modification of FIG. 12, the blades 16 for the impeller V described as composed of low loss dielectric material in the oven of FIG. 8 are replaced by blades 16' of metallic material for an impeller V' for also serving as a reflector of the electric waves. This arrangement is particularly effective for improving the electric field distribution in cases where favorable radiation pattern is not obtainable through adjustment of the configuration of the radiating member 11" alone.

In the microwave oven shown in FIG. 13, the impeller V' described as fixed to and rotating in synchronism with the radiating member 11" by the arms 17' in the arrangement of FIG. 12 is replaced by an impeller V" having blades 16" and rotatably mounted through the arms 17" for rotation independent of the rotation of radiating member 11". The member 11" is suitable connected, at one end thereof, to a driving shaft of the motor M' mounted on the lower surface of the waveguide 9' for being driven by the motor M', while the impeller V" is driven through the air flow caused by a suitable blower means (not shown).

It should be noted here that the configuration of the electric wave radiating member 11" is not limited to one shown in FIGS. 12 and 13, but may be suitably altered to take any other shapes, for example, those shown in FIG. 5 or 7 provided that the same sufficiently meet the purpose of efficient heat distribution within the heating chamber.

It should also be noted that, although in the modifications of FIGS. 12 and 13, blower means, ventilation openings and the like are not particularly shown, it is needless to say that such blower means, ventilation openings, are duct and the like may be incorporated as detailed with reference to FIG. 8.

Figure 14:
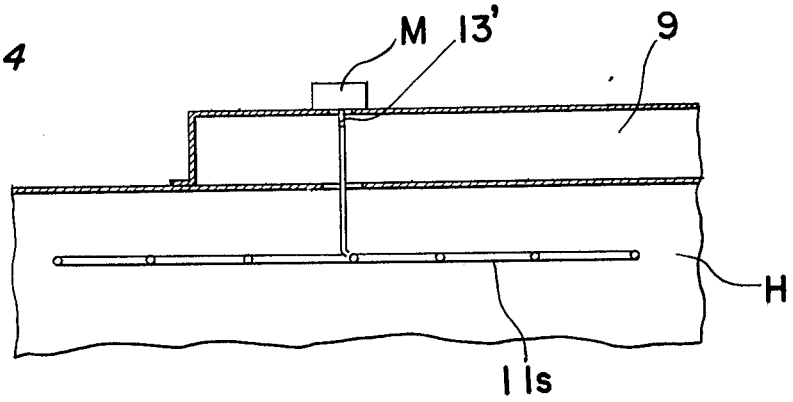
FIG. 14 is a fragmentary view showing, on an enlarged scale, a modification of the microwave oven of FIG. 7.
Figure 15:
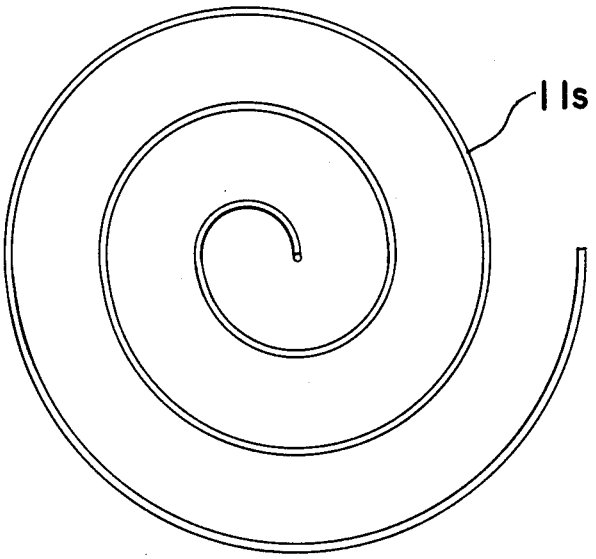
FIG. 15 is a top plan view of an antenna having a spiral shape employed in the microwave oven of FIG. 14.

Referring now to FIGS. 14 and 15, there is shown a further modification of the microwave oven of FIG. 7. In this modification, the electric wave radiating member 11' described as employed in the microwave oven of FIG. 7 is replaced by an antenna 11*s* of spiral shape as an electric wave radiating member which is connected, at the central end portion thereof through a supporting rod 13' of dielectric material, to the driving shaft of the motor M for rotation as shown. By rotating the spiral radiating member 11*s* upon energization of the motor M, uniformity of heat distribution is further improved in the microwave oven of the invention. Features of the antenna having the spiral configuration are described in U.S. Pat. No. 3,493,709, so that reference should be made thereto for details thereof.

It should be noted here that any metallic material such as a solid rod, hollow pipe or dielectric material having metallic coating on the surface and the like may be employed as the electric wave radiating member in the microwave ovens of FIGS. 5, 6, 7, 8, 12 or 13.

It should also be noted that the circular opening h in the wall between the waveguide and the heating chamber for radiating the electric wave therethrough should preferably be located in the central portion of such a wall of the heating chamber, and that the same wall having said opening therein and the wall opposite to it should preferably be of square shape since variation of impedance due to rotational angle of the electric wave radiating member is small in the above arrangement.

Referring back to FIG. 7, the dimensions of the heating cavity H to which the arrangement of the invention is applied should preferably be of non-resonating dimensions. More specifically, in the electric wave radiating member having configuration as shown in FIG. 7, it is desirable to suppress radiation of electric waves at the portions A and B of the radiating member 11', with the electric waves being mainly radiated from the end portion C thereof. When the oscillating frequency and the dimensions of the heating cavity are determined, the kind of standing waves likely to be developed in the heating cavity are readily found through simple calculations as disclosed, for example, on pages 28 to 32 of Microwave Power Engineering Vol. 2 edited by E. C. OKress, Academic Press. As well known in the art, if the distance between the A and B portions and the oven wall is less than ¼ wavelength, the A and B portions will not be efficient radiators and will be only loosely coupled as radiators to the heating cavity. Accordingly, if such loose coupling is made between the A and B portions of the electric wave radiating member 11' and the standing wave likely to be developed, the non-resonating condition is established, and by facilitating radiation of electric waves from the portion C of the radiating member 11', it is possible to obtain still higher uniformity of heat distribution.

Another example of the heating cavity dimensions is the so-called complementary cavity. As is seen from the literature mentioned above, the mode of the standing waves developed in a rectangular cavity is generally represented as TEm.n.p. by the number of electric fields each varying in the direction of x, y, or z. In the presence of two modes, for example, $TEm_1 \cdot n_1 \cdot p_1$ and $TEm_2 \cdot n_2 \cdot p_2$, if $m_1$ and $m_2$, $n_1$ and $n_2$, and $p_1$ and $p_2$ are in the relation of even number in one hand and of odd number in the other respectively, both are referred to as complementary modes.

Figure 16:
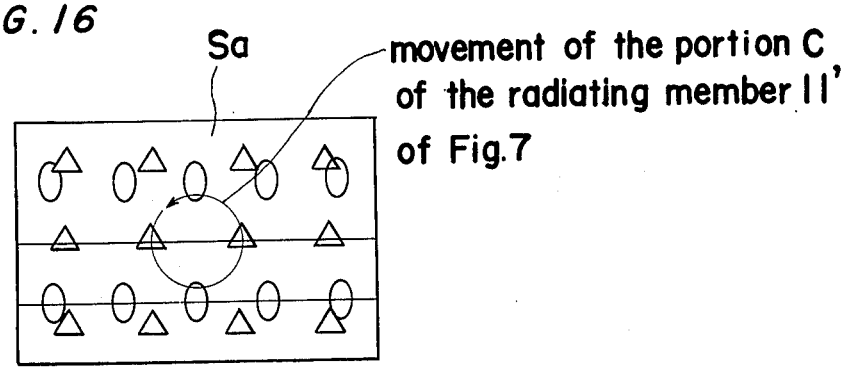
FIG. 16 is a schematic diagram showing the modes of standing waves developed in a rectangular heating cavity.

Referring to FIG. 16, there are shown such modes TE340 and TE250 for example. The marks Δ represent the maximum points of electric field of the mode TE340, while the marks O denote that of the mode TE250. With the cavity designed to develop such standing waves, if the portion of a radiating member equivalent to the portion C of the member 11' of FIG. 7 is moved through a locus as shown by a circle with an arrow in FIG. 16, a heating pattern wherein the two modes are combined is obtained with further improvement of the uniformity of heating distribution.

Figure 17:
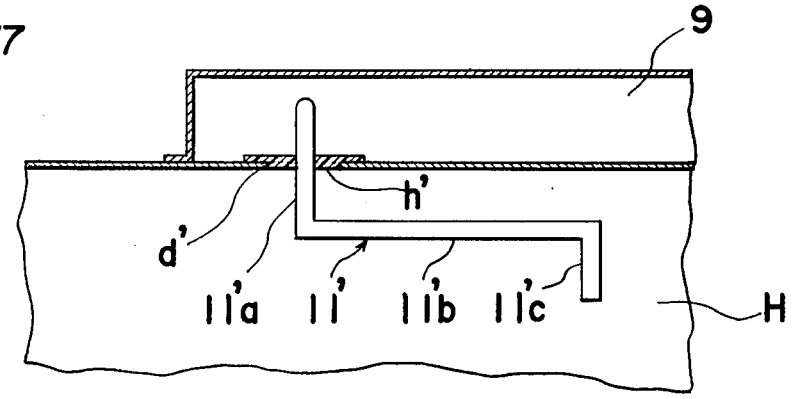
FIGS. 17 and 18 are fragmentary side sectional views showing, on enlarged scales, still further modifications of the arrangements of the elctric wave radiating members within the guidewaves employed in the foregoing embodiment and its modifications.
Figure 18:
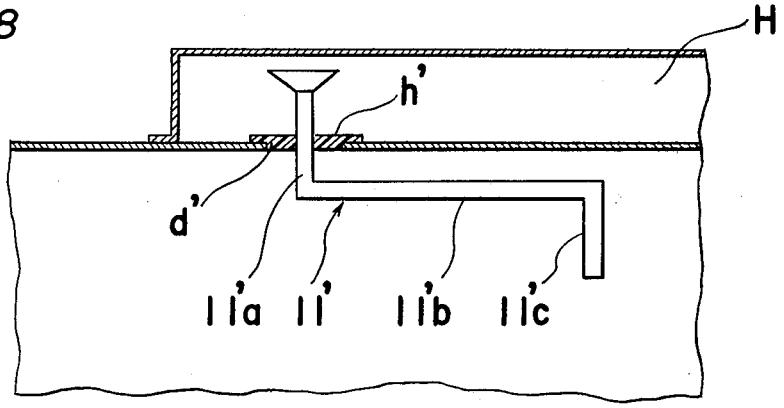

Referring also to FIGS. 17 and 18, there are shown still further modifications of the electric wave radiating member 11 such as the one employed in the modifications of FIGS. 7 and 8. It has also been found by the experiments conducted by the present inventors with respect to the finishing of the extreme end 11'*a* of the electric wave radiating member 11' within the waveguide 9 that such extreme end is effectively finished for prevention of spark discharge and for stabilization of the working point in the manner as described with reference to FIGS. 17 and 18. In FIG. 17, the extreme end of the end portion 11'*a* of the electric wave radiating member 11' extending into the waveguide 9 through the dielectric member d' fitted around the opening h' is rounded either by beveling or by forming the extreme end itself into a spherical shape, which arrangement is particularly effective for preventing electrical discharge between the wall of the waveguide 9 and the radiating member 11'. In the modification of FIG. 18, the extreme end of the radiating member 11' is not rounded as in FIG. 17, but is formed into an inverted cone shape, which arrangement is also effective for improving the stability of the working point of the magnetron (not shown).

Figure 19:
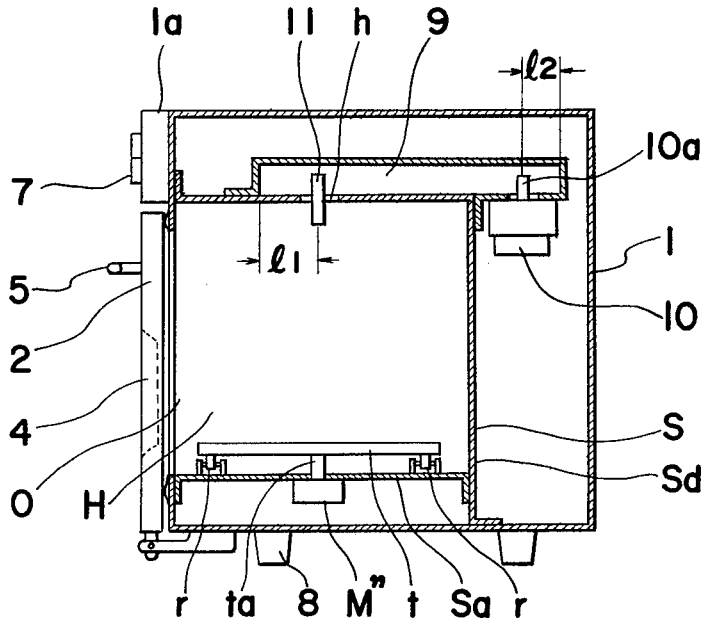
FIGS. 19 and 20 are views similar to FIGS. 5 and 7 respectively, but particularly showing further modifications thereof.
Figure 20:
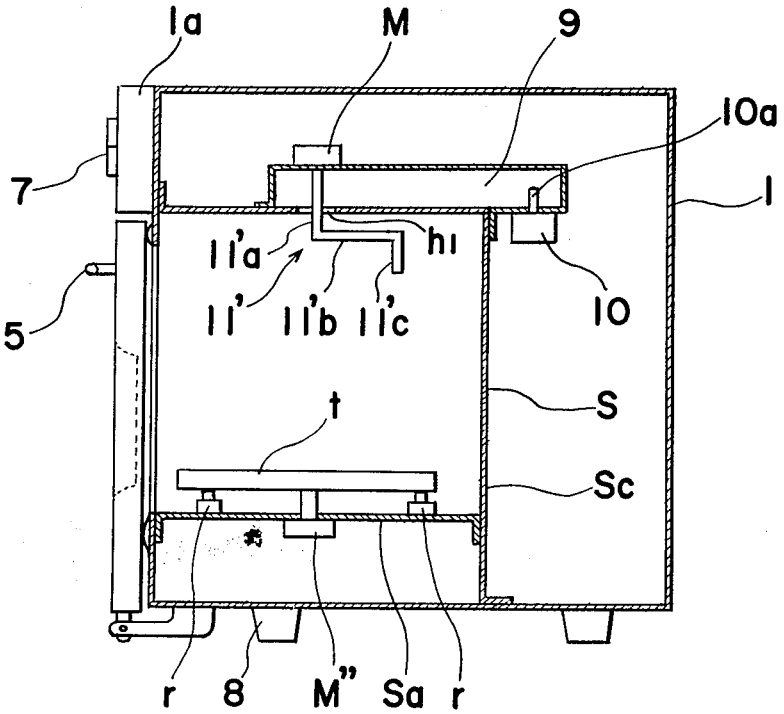

Referring now to FIGS. 19 and 20, there are shown still further modifications of the microwave ovens of FIGS. 5 and 7 respectively. In the modifications of FIG. 19, a turntable for placing thereon the object (not shown) to be heated is further incorporated. This turntable t is rotatably mounted generally at the central portion on the bottom wall Sa of the heating chamber H. It is suitably coupled for rotation, through a central shaft to thereof, to the motor M", with a plurality of roller members r being rotatably disposed between the under surface of the turntable t adjacent to peripheral edge thereof and the bottom wall Sa for stabilization of the table t during rotation of said turntable t. Although the stirrer fan 12 described as employed in the oven of FIG. 5 is dispensed within the arrangement of FIG. 19, such a fan may of course be incorporated depending on the necessity. Meanwhile, in the microwave oven of FIG. 20, which is another modification of the oven of FIG. 7, the turntable t is further incorporated in a manner similar to that in the modification of FIG. 19. In the arrangements of FIGS. 19 and 20, the effect of even heating is further obtained by the employment of the turntable in addition to the favorable effect described with reference to FIGS. 5 and 7.

Figure 21:
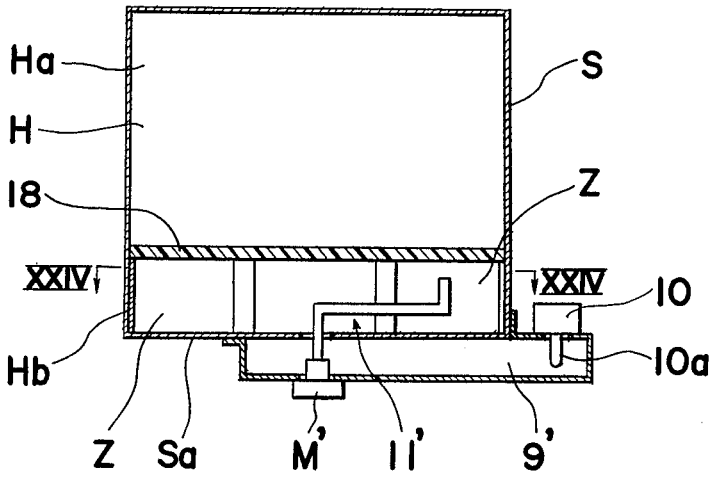
FIG. 21 is a view similar to FIG. 13, but particularly showing another modification thereof.
Figure 22:
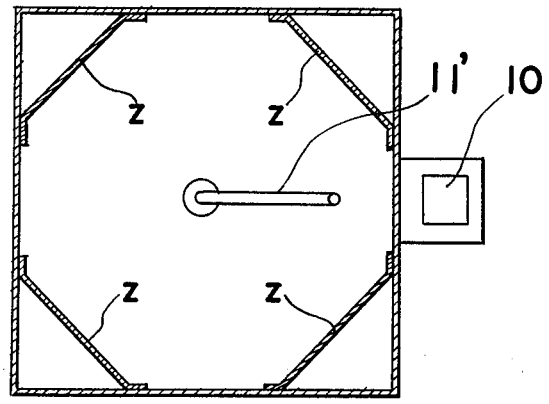
FIG. 22 is a cross sectional view taken along the line XXIV—XXIV of FIG. 21.

Referring now to FIGS. 21 and 22, there is shown another modification of the microwave oven of FIG. 13. In this modification, the electric wave radiating member 11" of approximately L-shape described as employed in the oven of FIG. 13 is replaced by the radiating member 11' of the type as detailed in the oven of FIG. 7. The impeller V" of FIG. 13 is dispensed with, and the radiating member 11' is adapted to be driven for rotation by the motor M'. In the lower heating chamber Hb, four rectangular plates Z, each secured to inner walls S of the heating chanber H in directions perpendicular to the bottom wall Sa of the chamber H and facing the corresponding corners of the chamber H, are provided to form a polygonal space surrounding the radiating member 11' in the lower heating chamber Hb as shown. By this arrangement, impedance variations following rotation of the radiating member 11' are advantageously reduced, thus efficient utilization of the magnetron 10 is achieved.

It should be noted here that the space described as formed in the lower heating chamber Hb of the microwave oven of FIG. 21 is not required to be octagonal, but may be of any configuration such as an ellipse, circle and the like so long as such a space is effective for reducing the impedance variations due to rotation of the electric wave radiating member 11'.

It should also be noted that the configuration of the radiating member is not limited to that of the member 11', but may be suitably altered to any other shape depending on the necessity.

Figure 23:
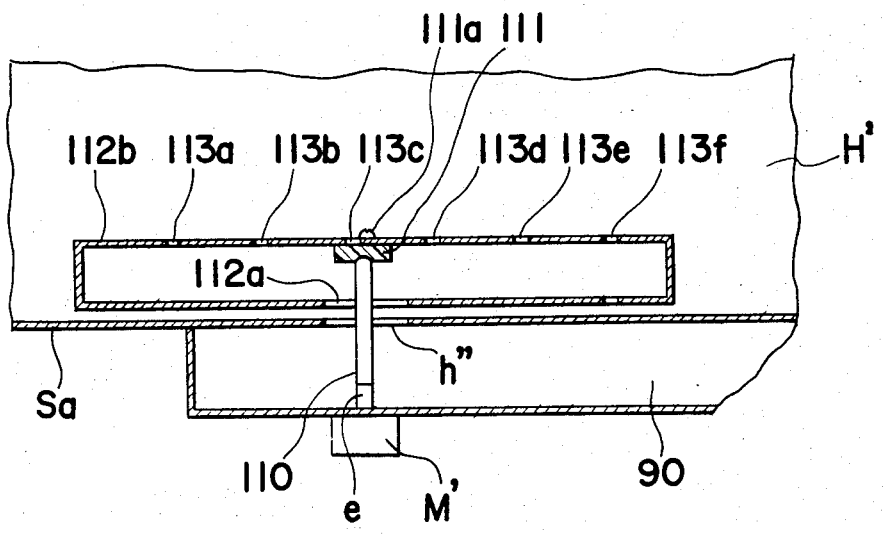
FIG. 23 is a fragmentary side sectional view showing, on an enlarged scale, a further modification of the arrangement between the waveguide and the heating cavity of the microwave oven of FIG. 21.
Figure 24:
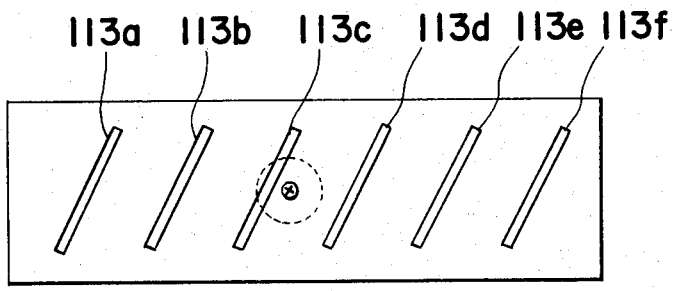
FIG. 24 is a fragmentary top plan view of an acting cavity employed in the modification of FIG. 23.

Referring now to FIGS. 23 and 24, there is shown a still further modification of the microwave oven of FIG. 21. In this modification, the plates Z described as employed in the oven of FIG. 21 are dispensed with, while the electric wave radiating member 11' is also replaced by a coupling member 110 of metallic material or the like.

It should be noted here that, although in the foregoing embodiments and modifications thereof, the metallic conductor 11 is mainly described as functioning both as a coupling member between the waveguide and the heating chamber, and also as the electric wave radiating member, the modification of FIG. 23 is characterized in that the metallic conductor 110 functions only as a coupling member. In FIG. 23, the metallic conductor 110 in the shape of a rod is coupled at one end to the shaft of the driving motor M' for rotation through a dielectric member 3 and at its other end, into the heating chamber H' through the opening h'' formed in the wall Sa between the waveguide 90 and the heating chamber H' and also through an opening **112*a* formed in a corresponding wall of a reradiation chamber 112 of a rectangular box-like configuration which is disposed above the wall Sa in spaced relation to said wall Sa. The extreme upper end of the conductor 110 is secured to the top wall 112*b* of the acting cavity 112 through an insulating spacer 111 by a fixing screw 111*a*. The top wall 112*b* of the reradiation chamber 112 is further provided with a plurality of slots 113*a* to 113*f* formed diagonally in said wall 112*b* in parallel and spaced relation to each other as is most clearly seen in FIG. 24. In this arrangement, the metallic conductor rod 110 has the function to couple through electric waves the waveguide 90 with the heating cavity H', with the electric waves being radiated into the heating cavity H' through the slots 113*a* to 113*f* formed in the top wall 112*b* of the reradiation chamber 112**.

It should be noted here that the number of the slots 113 is not limited to six, and the configurations of the slots or acting cavity may also be modified to any other shapes provided that the electric waves are efficiently radiated into the heating cavity therethrough.

It should also be noted here that, although the present invention is mainly described with reference to the microwave ovens in the foregoing embodiment and modifications therefor, the concept of the present invention is not limited in its application to microwave ovens, but may also be applicable to any other types of high frequency heating apparatus.

Although the present invention has been fully described by way of example with reference to the attached drawings, it is to be noted that various changes and modifications are apparent to those skilled in the art. Therefore, unless such changes and modifications depart from the scope of the present invention, they should be construed as included therein.

What is claimed is:

1. A high frequency heating apparatus comprising:

a heating cavity for placing therein an object to be heated, said heating cavity being formed in a substantially cubic box-like configuration and having a set of horizontal walls and a set of vertical walls;

an electric wave supplying means for supplying electric waves of a predetermined frequency into said heating cavity, said electric wave supplying means having a high frequency oscillator for producing said electric waves;

a waveguide mounted on one of said set of horizontal walls and extending along said wall, said waveguide being interconnected with said heating cavity through an aperture which is provided at a center portion of said wall and having dimensions which are smaller than ½ wavelength of said frequency of said electric waves from said high frequency oscillator so as to prevent a loose coupling of electric waves between said waveguide and said heating cavity when no object is within said aperture;

an electric wave coupling means provided between said heating cavity and said waveguide passing through said aperture and having an insulating material for separating said electrical wave coupling means from said heating cavity and said waveguide, said coupling means having a substantially non-symmetric configuration and having a receiving portion arranged within said waveguide for receiving said electric waves and having a rotatable radiating L shaped portion arranged within said heating cavity, said L shaped portion being an end portion which substantially extends along said horizontal wall and is connected to said receiving portion through said aperture for radiating said electric waves received by said receiving portion into said heating chamber in a uniform heat distribution by the periodic variation of an electric wave radiation pattern;

a support member for rotatably supporting said electric wave coupling means;

a driving means for rotating said radiating portion of said electric wave coupling means; and, a dielectric member disposed between said heating cavity and said waveguide within said aperture for preventing passage of unwanted matter from entering said waveguide yet allowing passage of said electric waves from said electric wave coupling means.

2. A high frequency heating apparatus as claimed in claim 1, further comprising:

a blower means for causing a flow of air;

a duct means coupled to said blower means for causing said flow of air to pass and cool said high frequency oscillator and then to pass said radiating portion of said electric wave coupling means;

wherein said driving means comprises an impeller means connected to said radiating portion of said electric wave coupling means for causing said radiating portion to rotate when said flow of air passes said radiating portion.

3. A high frequency heating apparatus as claimed in claim 1, wherein said radiating portion of said electric wave coupling means comprises an antenna having a dielectric material with a metallic surface coating.

4. A high frequency heating apparatus as claimed in claim 1, wherein the size and shape of said heating chamber and said frequency of said electric waves from said high frequency oscillator are selected such that said radiating portion of said electric wave coupling means excites complementary mode standing waves.

5. A high frequency heating apparatus as claimed in claim 1, wherein the size and shape of said heating chamber and said frequency of said electric waves from said high frequency oscillator are selected such that said radiating portion of said electric wave coupling means does not excite any resonant modes.

6. A high frequency heating apparatus as claimed in claim 1, wherein said aperture has a circular shape with a diameter which is less than ½ wavelength of said frequency of said electric waves from said high frequency oscillator.

7. A frequency heating apparatus as claimed in claim 1, wherein said receiving portion of said electric wave coupling means comprises a straight rod having a circular cross-section at its extreme and extending into said waveguide.

8. A high frequency heating apparatus as claimed in claim 1, wherein said receiving portion of said electric wave coupling means comprises a straight rod having at its extreme and extending into said waveguide an inverted cone shape, the base of said cone facing a corresponding wall of said waveguide.

9. A high frequency heating apparatus as claimed in claim 1, further comprising a stirrer means for random scattering of high frequency energy radiated by said radiating portion of said electric wave coupling means.

10. A high frequency heating apparatus as claimed in claim 1, wherein said radiating portion of said electric wave coupling means comprises an antenna in the form of a rod.

11. A high frequency heating apparatus as claimed in claim 10, wherein said antenna comprises a first antenna portion having a length which is less than ¼ wavelength of said frequency of said electric waves from said high frequency oscillator and is arranged to be perpendicular to said wall of said heating chamber having said aperture; and wherein said antenna further comprises a second antenna portion which is arranged to be parallel to said wall of said heating chamber having said aperture and wherein said antenna still further comprises a third antenna portion having a length which is at least ¼ wavelength of said frequency of said electric waves from said high frequency oscillator and is arranged to be perpendicular to said wall of said heating chamber having said aperture.

12. A high frequency heating apparatus as claimed in claim 1, further comprising a high frequency energy reflecting means associated with said radiating portion of said electric wave coupling means for reflecting high frequency energy radiated by said radiating portion of said electric wave coupling means.

13. A high frequency heating apparatus as claimed in claim 12, further comprising a reflector rotation means connected to said high frequency energy reflecting means for causing said high frequency energy reflecting means to rotate in synchronism with the rotation of said radiating portion of said electric wave coupling means.

14. A high frequency heating apparatus as claimed in claim 12 further comprising a reflector rotation means connected to said high frequency energy reflecting means for causing said high frequency energy reflecting means to rotate independently of the rotation of said radiating portion of said electric wave coupling means.

* * * * *